US006659671B1

(12) United States Patent
Fukami et al.

(10) Patent No.: US 6,659,671 B1
(45) Date of Patent: Dec. 9, 2003

(54) INK INTRODUCING TUBE AND WRITING INSTRUMENT INCORPORATED WITH THE SAME

(75) Inventors: Masaaki Fukami, Fuchu (JP); Shigeo Yamada, Minato-ku (JP)

(73) Assignee: Tsukasa Felt Shoji Kabushiki Kaisha, Tokyo (JP)

( * ) Notice: Subject to any disclaimer, the term of this patent is extended or adjusted under 35 U.S.C. 154(b) by 52 days.

(21) Appl. No.: 10/286,773

(22) Filed: Nov. 4, 2002

(51) Int. Cl.[7] ..... B43K 5/00; B43K 8/06
(52) U.S. Cl. ..... 401/198; 401/196; 401/205
(58) Field of Search ..... 401/196, 198, 401/199, 205

(56) References Cited

U.S. PATENT DOCUMENTS

| | | | | | |
|---|---|---|---|---|---|
| 3,933,965 | A | * | 1/1976 | Gallone et al. | 401/199 |
| 4,207,013 | A | * | 6/1980 | Shimoishi | 401/199 |
| 4,840,509 | A | * | 6/1989 | Ito et al. | 401/198 |
| 5,967,687 | A | * | 10/1999 | Oike | 401/198 |
| 6,322,269 | B1 | * | 11/2001 | Witz et al. | 401/198 |
| 6,474,893 | B1 | * | 11/2002 | Osada et al. | 401/198 |

FOREIGN PATENT DOCUMENTS

| | | | |
|---|---|---|---|
| DE | 41 15 685 A1 | | 11/1992 |
| EP | 0 516 538 A1 | | 12/1995 |
| JP | 409193588 A | * | 7/1997 |

* cited by examiner

*Primary Examiner*—Tuan N. Nguyen

(57) ABSTRACT

Provided is an ink introducing tube which realizes a stabilized ink supply from an ink tank located at the rear portion of a felt pen into a tip at the front end thereof, and a writing instrument incorporating it. On the inner peripheral wall of an ink introducing tube through which an ink tank is communicated with a tip located at the front end, a plurality of protrusions are formed to provide therebetween a passage for downward flow which utilizes the capillary action of the protrusions, and the interior space of the ink introducing tube which is surrounded by the tips of the plural protrusions is formed as a large space so that the capillary action can take place. Thus, the flow of air to the ink tank moves upwardly through the interior space while changing into air foam during the ascent, whereas the ink flows downward while being retained between the protrusions. Therefore, replacement of the ink by the air can be performed smoothly whereby ink blobbing is prevented and flawless writing is realized.

5 Claims, 5 Drawing Sheets

FIG. 5 PRIORART
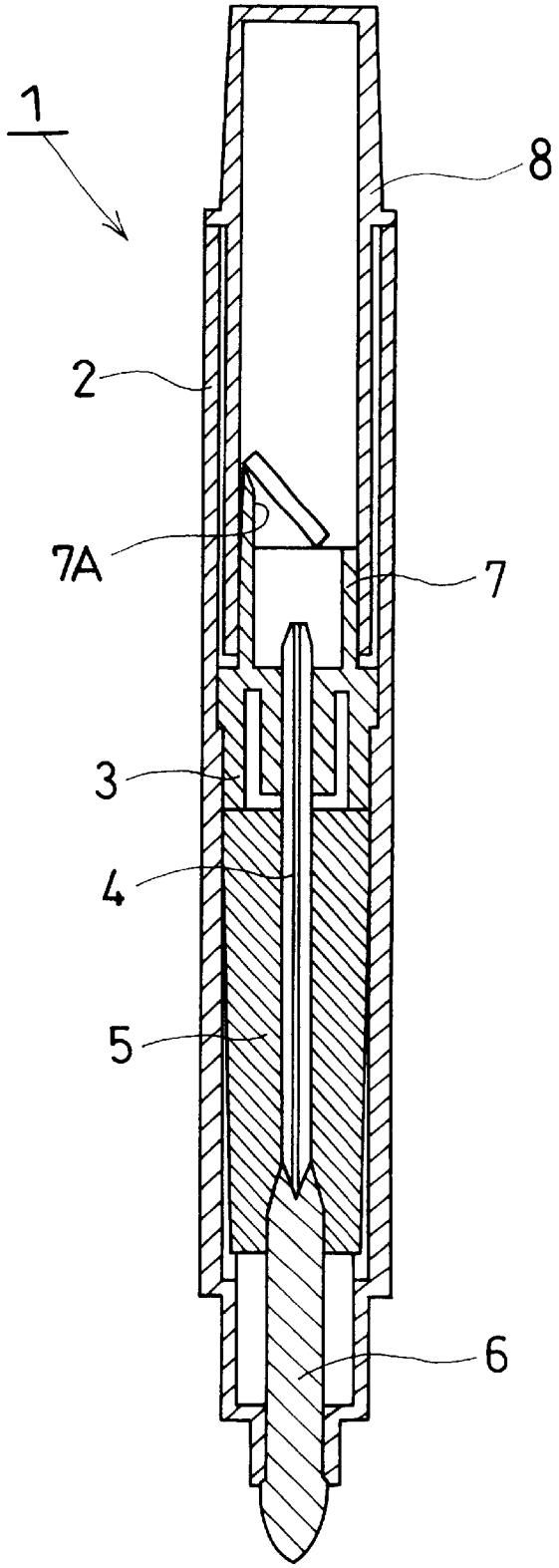

FIG. 6 PRIORART
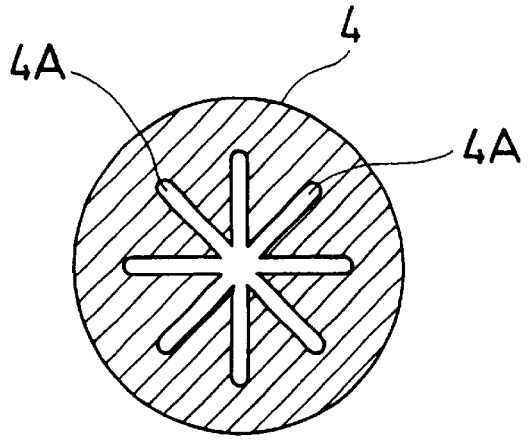
FIG. 7 RELATED ART
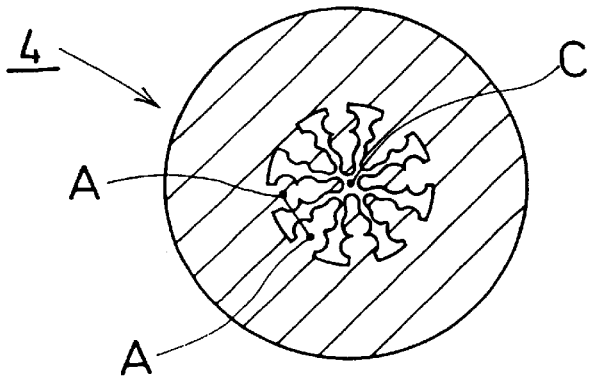
FIG. 8 RELATED ART
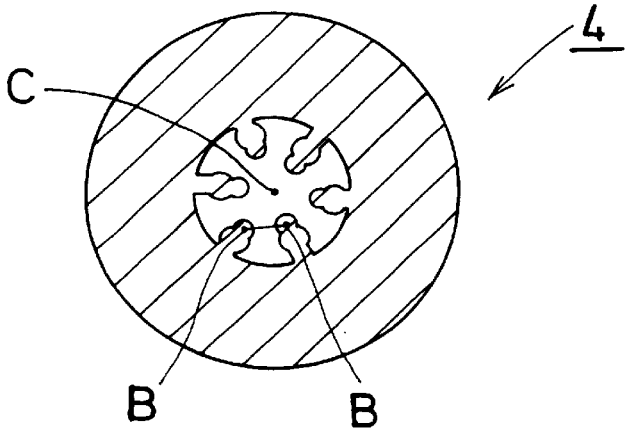

INK INTRODUCING TUBE AND WRITING INSTRUMENT INCORPORATED WITH THE SAME

BACKGROUND OF THE INVENTION

1. Field of the Invention

Most writing instruments include a tank for pooling ink in order to allow writing to be performed for a long period of time. Some of them are provided with an ink introducing tube for feeding only a sufficient amount of ink from an ink tank to a writing point (nib, ballpoint, plastic tip, etc.).

The present invention relates to an ink introducing tube for introducing ink pooled in an ink tank to a writing point, and to a writing instrument incorporating the ink introducing tube therein.

2. Description of the Related Art

Conventional writing instruments include, for example, a fountain pen which may be refilled by replacing a spare ink tank (cartridge) storing fluid ink.

In a writing pen 1 shown in FIG. 5, a rigid intermediate member 3 is fixed in a central interior portion of a tubular housing 2, and an ink introducing tube 4 supported by the intermediate member 3 is held by a tubular inner cotton member 5 arranged in front of the intermediate member 3. Further, the ink introducing tube 4 is coupled to a writing nib 6 at the front portion of the inner cotton member 5. On the other hand, an ink tank holding tube body 7 having a protrusion 7A is formed in the rear end portion of the intermediate member 3, and a cartridge type ink tank 8 is inserted in the ink tank holding tube body 7, thus enabling writing to be performed. Also, the rear end of the ink introducing tube 4 is projected into the ink tank holding tube body 7 so that it comes into contact with the ink within the ink tank. As shown in FIG. 6, in cross section, the ink introducing tube 4 has 8 slit-like ink introducing grooves 4A that radially extend from the center.

The ink introducing tube 4 allows ink to flow toward the direction of the nib by capillary action of the slits. Due to the capillary action, the ink thus supplied is impregnated into the inner cotton member 5 in both the radial and axial directions so that it is retained in the cotton member 5. Further, the ink introducing tube 4 is formed such that greater capillary action is exerted on the nib 6 side than on the intermediate member 3 side in the axial direction of the pen. The ink supplied from the ink introducing tube 4 moves to the nib 6 formed of a porous felt member, a sintered synthetic resin, or the like. At this time, any surplus ink is absorbed by the inner cotton member 5 at the coupling portion.

When writing is performed with the above-described writing pen 1, as ink is consumed, the ink transfers from the ink tank 8 to the nib side due to the capillary action exerted by the slits 4A. At this time, since the ink tank 8 is in a closed state except for the ink introducing tube 4, outflow of ink does not take place unless the ink within the ink tank is replaced by air from the outside. That is, air corresponding to the amount of used ink enters into the ink tank 8 through the nib 6 and the ink introducing tube 4, thus balancing the pressure with the outside. However, if the interchange of air with the ink does not take place in a satisfactory manner, the pressure within the ink tank 8 becomes low so that the ink drops less easily, leaving skips in drawn ink lines. Conversely, if the air within the ink tank 8 rapidly expands when the amount of air inside the ink tank 8 is already increasing, more ink is pushed out in correspondingly greater force, causing sudden thickening of drawn letters or ink blobbing.

In view of the above, in order to enable a relatively large amount of ink to be supplied from the ink tank 8, an attempt was made to cause the capillary action to take place at various many locations by using the ink introducing tube 4 having a construction such as shown in FIG. 7. That is, the ink introducing tube 4 is formed having a cross section in which protrusions are formed from the outer periphery toward the inner periphery thereof (i.e., by being extended to the vicinity of the center), thus increasing the total area of the slits formed therebetween. Note that the slit width of the protrusion is set to 50 microns at a section A—A, and a central space C is set to approximately the same value. Although this allows an increase in the amount of ink retained in the ink introducing tube 4, the ink retained in the slits obstructs movement of air to the ink tank 8, so that air does not enter into the ink tank 8, resulting in extremely poor ink ejection.

On the other hand, as shown in FIG. 8, as an attempt to allow a large amount of air to enter into the ink tank 8 more easily, the cross section of the ink introducing tube 4 is formed such that protrusions each having a small height are projected toward the central portion, with wider intervals being set therebetween. That is, the width of the space B—B capable of capillary action which is formed by the protrusions having a small height is set to 100 microns, and the central space C is set to approximately the same value. In this case, the replacement of ink in the ink tank 8 by air from the outside is performed extremely easily, with a result that excessive outflow of ink becomes liable to occur to cause writing unevenness.

SUMMARY OF THE INVENTION

The present invention has been made based on the above findings, and an object thereof is to provide an ink introducing tube in which air can be easily introduced into an ink tank and also excellent ink flowing action that is suitable for writing can be attained, and a writing instrument incorporating the ink introducing tube therein.

In order to attain the above object, a first aspect of the present invention relates to an ink introducing tube for introducing ink from an ink tank of a closed writing instrument into a writing tip characterized in that in the ink introducing tube, a plurality of protrusions are formed from the inner peripheral surface thereof toward the center so as to exert strong capillary action and are extended in the axial direction, and a central space surrounded by the free ends of the plurality of protrusions is formed with such a cross sectional area that would make the capillary action difficult to take place therein, over the entire length of the ink introducing tube.

According to a second aspect of the present invention, the plurality of protrusions are formed having the respective lengths of long and short protrusions oriented toward the central portion being aligned with each other so that substantially the same capillary action can be exerted between the plurality of protrusions even as they come closer to the central space of the ink introducing tube.

According to a third aspect of the present invention, the intervals between the plurality of protrusions are set to approximately 10 to 100 microns and transverse distances therebetween in the central space are set to approximately 100 to 1000 microns.

According to a fourth aspect of the present invention, an ink tank is provided inside a writing instrument shaft portion; the ink tank is communicated with a writing tip located at the forward end of the writing instrument shaft portion through an ink introducing tube, the ink introducing tube including axially extended portions with strong capillary action which.are provided along its inner peripheral surface and a cylindrical space with weak capillary action which is formed in its central portion, and the periphery of the portion where the ink introducing tube and the writing tip are connected is surrounded by an inner wick having the capillary action.

With the above-described construction of the ink introducing tube of the present invention, even in the case of ink having a slightly high viscosity, it can be smoothly replaced by the outside air to allow smooth supply of the ink from the ink tank to the writing tip. Further, a writing instrument incorporating the ink introducing tube of the present invention is also expected to enable smooth writing.

BRIEF DESCRIPTION OF THE DRAWINGS

In the accompanying drawings:

FIG. 5 is a sectional view showing a writing pen known in the art;

FIG. 6 is a cross sectional view of an ink introducing tube shown in FIG. 5;

FIG. 7 is a cross sectional view showing an assumed ink introducing tube; and FIG. 8 is a cross sectional view showing an assumed ink introducing tube.

DETAILED DESCRIPTION OF THE PREFERRED EMBODIMENTS

Hereinbelow, embodiments of the present invention will be described with reference to the accompanying drawings.

Figure 4:
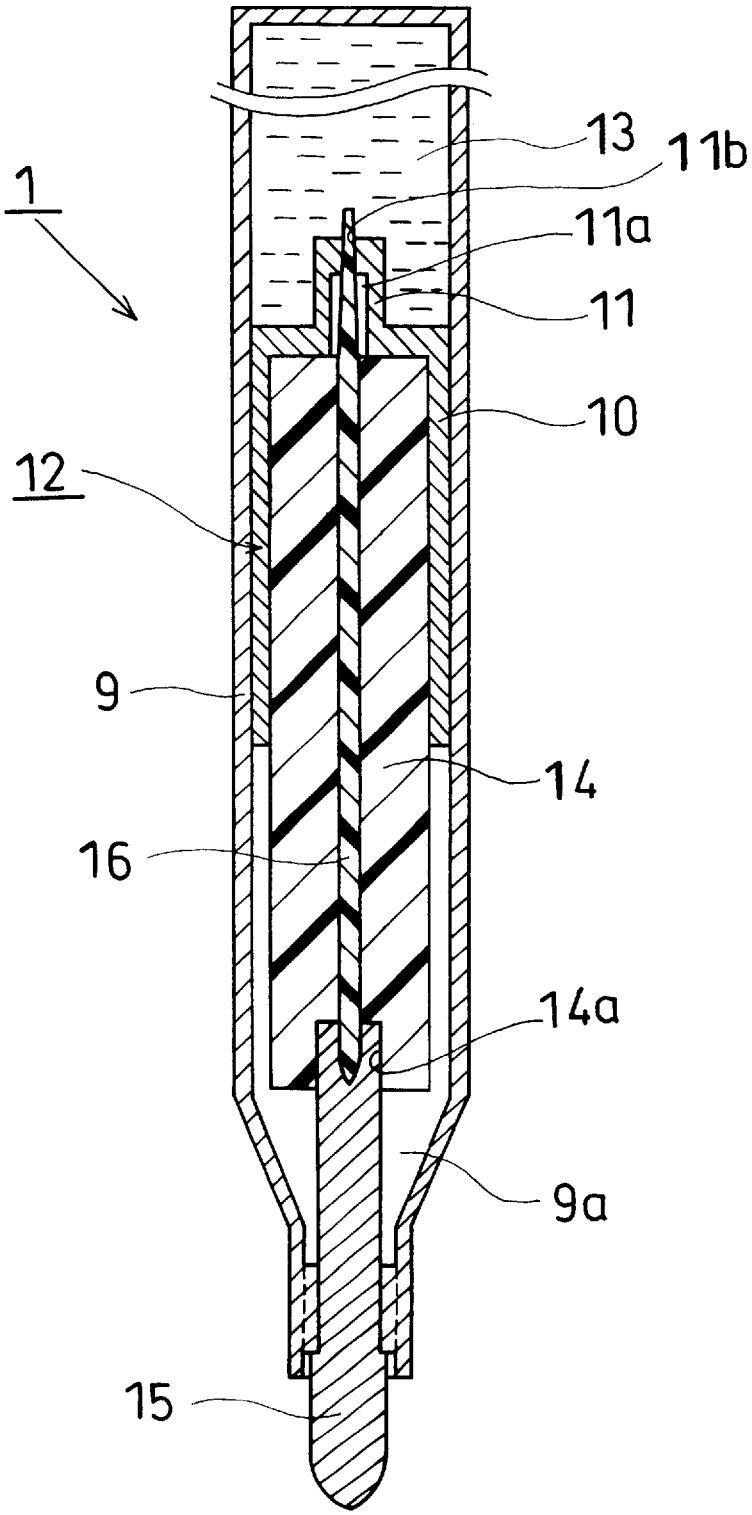
FIG. 4 is a longitudinal sectional view of a writing pen containing an ink introducing tube in accordance with the present invention.

A writing pen 1 shown in FIG. 4 comprises a tubular housing (a writing instrument shaft portion) 9 having a bottom which includes an ink tank 13, a writing tip 15 attached to the front end of the housing 9, and an ink introducing tube 16 disposed between the ink tank 13 and the tip 15.

In more detail, a large diameter portion 10 of a core 12 is tightly fitted with the inner wall of the housing 9, and the ink tank 13 is formed in the bottom portion of the housing 9. The core 12 has a small diameter portion 11 formed in the rear end of the large diameter portion 10, and the small diameter portion 11 includes a small diameter hole 11*b* which penetrates to the interior of the ink tank 13. The rear portion of an inner wick (inner cotton) 14 is inserted to the large diameter portion 10 of the core 12, and the outer peripheral surface of the front portion of the inner wick 14 is not brought into contact with the inner wall of the housing 9 but is surrounded by an air space 9a formed in that area. A round concave portion 14*a* is formed on the front face of the inner wick 14. The tip 15 is constituted by a porous felt member or the like, and its front end is projected to the outside from the front end of the housing 9 whereas its rear end is fitted in the round concave portion 14*a* of the inner wick 14.

The rear end of the ink introducing tube 16 protrudes into the ink tank 13 while being supported by the small diameter hole 11*b* formed in the small diameter portion 11 of the core 12. The front end portion of the ink introducing tube 16 penetrates through the center of the tubular inner wick 14 and protrudes into the round concave portion 14*a* to be engaged with the rear end of the tip 15. An air reservoir 11*a* is formed inside the small diameter portion 11 of the core 12.

When the connecting portion of the tip 15 and the ink introducing tube 16 is thus surrounded by the inner wick 14, if ink is supplied to the rear end of the tip 15 in excess, the overflow of ink which was not able to enter into the tip 15 is absorbed and retained by the inner wick 14. That is, due to the capillary action of a capillary portion that constitutes the inner wick 14, ink is accumulated successively from the front portion of the inner wick 14 to the rear portion thereof. The air reservoir 11*a* of the small diameter portion 11 of the core 12 serves to aid the capillary action of the inner wick (inner cotton) 14.

The ink introducing tube 16 is disposed between the ink tank 13 and the tip 15, through which ink is supplied from the ink tank 13 to the rear end portion of the tip 15. When supplying, ink, the ink introducing tube 16 also serves to allow upward passage of the air that has entered from the tip 15 side, which in turn facilitates flow of the ink downward. The ink introducing tube 16 is a cylindrical body and prevents ink from being flown out from the side peripheral walls of the tube 16.

Now, the construction of the ink introducing tube will be described with reference to FIG. 1.

The ink introducing tube 16 is formed of a synthetic resin, and a plurality of protrusions 17 oriented toward the central portion are formed on its inner peripheral wall and are extended in the axial direction. Further, three different heights (high, medium and low) are set for the plurality of protrusions 17 of the ink introducing tube 16, but none of which is a height that allows the protrusions 17 to reach the central portion. The free end of each protrusion is formed as a ball-shaped edge. In order for the capillary action to effectively take place in the vicinity of the inner wall of the ink introducing tube 16, the protrusions 17*a* having the largest height are arranged at equal intervals on the inner wall, the medium protrusions 17*b* are each formed between the high protrusions 17*a*, and the low protrusions 17*c* are each formed between the high protrusions 17*a* and the medium protrusions 17*b*. Further, concavo-convex patterns are formed on both side surfaces of the respective protrusions 17 along the longitudinal direction thereof.

Figure 1:
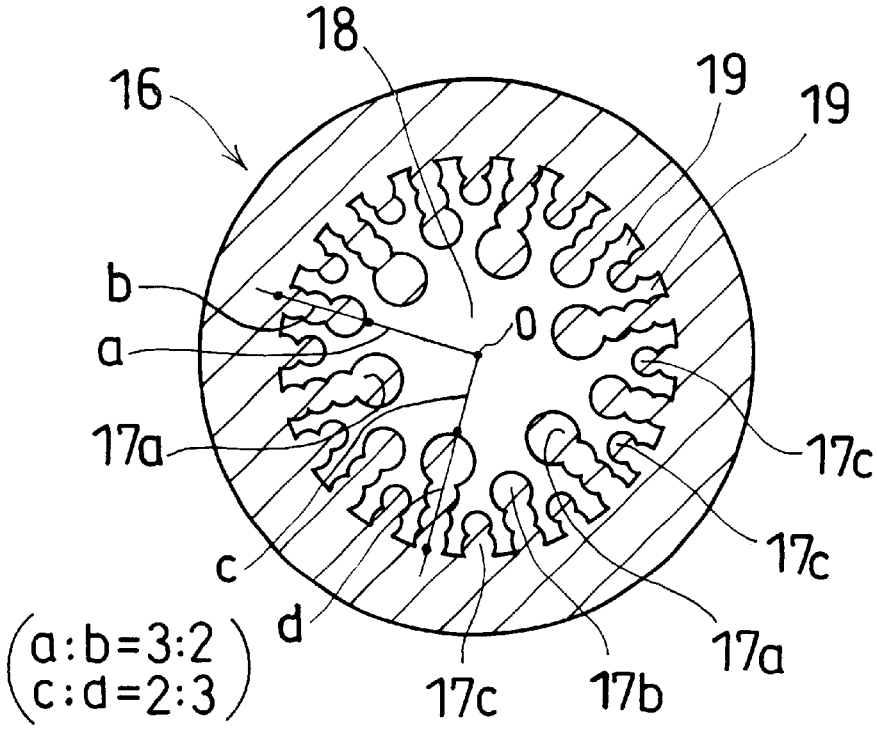
FIG. 1 is a cross sectional view of an ink introducing tube in accordance with the present invention.

As shown in FIG. 1, the intervals 19, 19 . . . between the respective protrusions 17 that are formed on the inner peripheral wall of the ink introducing tube 16 are substantially equal with each other. The intervals between the respective side walls of the protrusions are set as approximately 10 to 100 microns. In addition, the medium protrusions 17*b* oriented toward the center "0" shown in FIG. 1 are formed such that a:b becomes approximately 3:2 in the line segment running between shown small black points, and the long protrusions 17*a* are formed such that c:d becomes approximately 2:3 in the line segment running between shown small black points. These ratios can be changed. For example, a:b may be appropriately 1:1.2 and c:d may be approximately 3.5:2.

Figure 3:
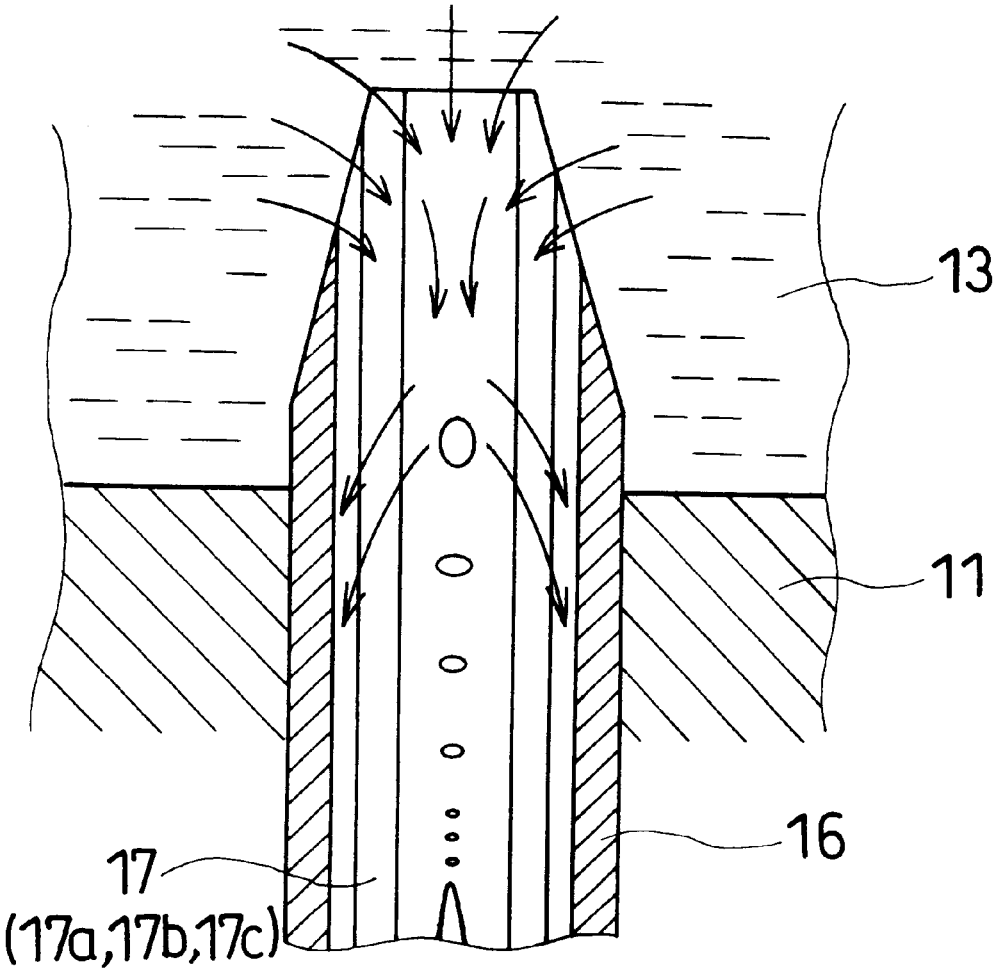
FIG. 3 is a longitudinal sectional view showing the vicinity of a rear end portion of an ink introducing tube in accordance with the present invention which is located within an ink tank.

A central space (cylindrical space) 18 of the inner portion of the ink introducing tube 16 which is surrounded by the respective free ends of the long protrusions 17*a* and the medium protrusions 17*b* serves as a space through which the outside air is delivered upward, that is, toward the ink tank 13. The rear end portion of the ink introducing tube 16 is always surrounded by and therefore filled with ink within the ink tank 13 until the ink is used up. As the ink flows downward, it moves .to the peripheral wall side where strong capillary action takes place, and therefore, presumably, the lower portion of the central space 18 of the ink introducing tube 16 is filled with air that is moving upward, which changes into air foam during the ascent and enters into the ink tank 13 to replace ink. (FIG. 3)

With regard to the proportion of the central space 18 to the protrusions 17 in the area inside the inner peripheral wall of the ink introducing tube 16 shown in FIG. 1, as seen in the radius, it is 2 (central space 18): 3 (protrusion 17) with respect to the long protrusions 17*a*, and it is 3 (central space 18): 2 (protrusion 17) with respect to the medium protrusions 17*b*.

The central space 18 is formed to be approximately 500 microns based on mean transverse distance. As regards the transverse distances in the central space, the transverse distance is, for example, 400 microns between the long protrusions 17*a* and it is 1000$\mu$ between the medium protrusions 17*b*. The preferable range of the transverse distance between the long protrusions is approximately 300 to 500 microns.

Figure 2:
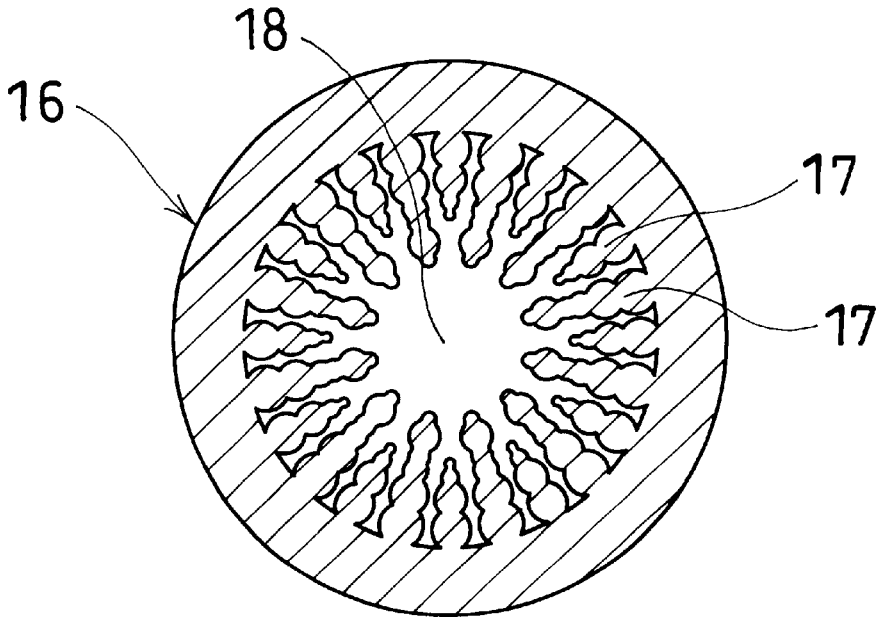
FIG. 2 is a cross sectional view of an ink introducing tube in accordance with another embodiment of the present invention.

FIG. 2 shows another embodiment in which low protrusions are not used and medium and long protrusions are used unlike the embodiment shown in FIG. 1. The long and medium protrusions 17 are closed to each other and protrude towards the center of the ink introducing tube 16.

As has been described, above, the passage for ascending air is secured by means of the central space 18 and the ink flow passage is secured by means of the capillary action exerted between the protrusions 17, whereby the air does not interfere with the downward flow of the ink, so that smooth writing can be realized.

Further, in the case when writing-is performed at a high speed, more ink flows in the vicinity of the inner peripheral wall where greater capillary action is exerted, so that the upward movement of air can be secured by the central space 18 even when air foam increases, thereby achieving excellent writing with good ink flowing action yet without the fear of ink blobbing.

Further, the protrusions 17 are continuously formed along the inner surface of the cylindrical body and they are formed in such a manner that they absorb the ink well and the ink can be sufficiently impregnated into portions between the protrusions 17.

In summary, the writing pen (writing instrument) 1 incorporating the ink introducing tube 16 therein has an advantage such that, as described above, during writing, the air that has entered through the tip moves through the central space while the ink retained between the protrusions 17 goes round to the tip 15 side, so that the balance between the entering of air and the ink impregnated into the portions between the protrusions 17 is retained to eliminate the problem of ink blobbing and ensure smooth writing.

The present invention has been explained by the above description. That is; in accordance with the first aspect of the present invention, in the ink introducing tube, the plurality of protrusions are provided on the inner peripheral wall thereof to form grooves having the capillary action, and the central space is formed in the central portion thereof. By this constitution, the ink is retained within the ink introducing tube due to the capillary action to avoid ink blobbing, and during writing, the air that has entered through the tip moves through the central space and thus does not obstruct the downward flow of ink to deliver a steady flow of the ink. In addition, even in the case when writing is performed at increased speed, the air is smoothly moved and thus does not obstruct the downward ink flow so that the drawn ink lines never becomes blurry or faded.

In accordance with the second aspect of the present invention, the plurality of protrusions are formed having the respective lengths of long and short protrusions being aligned with each other. As a result, the area where the capillary action takes place is progressively increased toward the central portion. so that a large amount of ink can be retained, thereby realizing a steady supply of ink.

In accordance with the third aspect of the present invention which represents the best embodiment m ode thereof, sufficient capillary action can take place between the plurality of protrusions, the central space is formed to have a size that would allow smooth movement of the air entering thereinto, and the interchange between the air and ink can be made smoothly, so that writing can be performed under a sufficient ink supply and also ink blobbing or ink leakage can be prevented.

In accordance with the fourth aspect of the present invention, during usage of the writing instrument, the ink pooled in the ink tank moves to the writing tip due to portions of the ink introducing tube with strong capillary action which are formed along the inner peripheral surface thereof, and air enters from. the tip and through the central space of the ink introducing tube into the ink tank thus having sucking pressure. As a result, the air does not obstruct the downward flow of the ink so that smooth writing can be continuously performed without blurring or fading of the, drawn lines.

In addition, in the case.where the writing instrument is laid horizontally, even when ink is moved to flow toward the tip, the ink is absorbed by the inner wick to avoid ink blobbing.

What is claimed is:

1. An ink introducing tube for introducing ink from an ink tank of a closed writing instrument into a writing tip characterized in that the ink introducing tube comprises a plurality of protrusions formed from the inner peripheral surface of the tube toward the center so as to exert strong capillary action and extended in the axial direction, and intervals between the plurality of protrusions being set to approximately 10 to 100 microns, and a central space surrounded by the free ends of the plurality of protrusions, and has transverse distances therein set to approximately 100 to 1000 microns that would make the capillary action difficult to take place in the central space, over the entire length of the ink introducing tube.

2. An ink introducing tube for introducing ink from an ink tank of a close writing instrument into a writing tip as claimed in claim 1, wherein the transverse distance of the central space are set to approximately 300 to 500 microns.

3. A writing instrument, comprising an ink tank provided inside a writing instrument shaft, a writing tip located at a forward end of the writing instrument shaft, an ink introducing tube, provided with connections between the ink tank and the writing tip in the writing instrument shaft, which has axially extended portions with strong capillary action surface formed longitudinally along an inner peripheral surface of the ink introducing tube and a cylindrical spaces, surrounded by free ends of the plurality of protrusions formed in a central portion of the ink introducing tube, that would make the capillary action difficult to take place with cylindrical space, and an inner wick having the capillary action for surrounding a periphery of the portion where the ink introducing tube and the writing tip are connected.

4. A writing instrument as claimed in claim 3, wherein a periphery of the portion where the ink tank and the ink introducing tube are connected, is provided with an air reservoir.

5. A writing instrument as claimed in claim 3, wherein the transverse distances of the central space is set to approximately 300 to 500 microns.

* * * * *